US009323205B2

(12) United States Patent
Mine et al.

(10) Patent No.: US 9,323,205 B2
(45) Date of Patent: Apr. 26, 2016

(54) SHEET BINDING PROCESSING APPARATUS, IMAGE FORMING SYSTEM AND BINDING METHOD

(71) Applicant: CANON KABUSHIKI KAISHA, Tokyo (JP)

(72) Inventors: Ryuta Mine, Toride (JP); Toshiyuki Abe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/463,764

(22) Filed: Aug. 20, 2014

(65) Prior Publication Data

US 2015/0069693 A1 Mar. 12, 2015

(30) Foreign Application Priority Data

Sep. 10, 2013 (JP) ..... 2013-187089
Jul. 24, 2014 (JP) ..... 2014-150578

(51) Int. Cl.
*B65H 37/00* (2006.01)
*G03G 15/00* (2006.01)

(52) U.S. Cl.
CPC ..... *G03G 15/6544* (2013.01); *B65H 2301/163* (2013.01); *B65H 2301/51611* (2013.01); *B65H 2408/122* (2013.01); *B65H 2408/1222* (2013.01); *B65H 2408/1223* (2013.01); *G03G 15/6541* (2013.01)

(58) Field of Classification Search
CPC ..... B65H 2408/1223; B65H 2408/122; B65H 2301/51611; B65H 2301/1635; B65H 2301/163; B65H 2408/1222; G03G 15/6544; G03G 15/6541; G03G 2215/00827
See application file for complete search history.

(56) References Cited

U.S. PATENT DOCUMENTS

| | | | | |
|---|---|---|---|---|
| 7,407,156 | B2 | 8/2008 | Iizuka et al. | |
| 8,104,757 | B2 * | 1/2012 | Taki et al. | 270/58.09 |
| 2014/0151950 | A1 * | 6/2014 | Hata et al. | 270/58.11 |

FOREIGN PATENT DOCUMENTS

JP 2013-126911 A 6/2013

OTHER PUBLICATIONS

Search Report issued in corresponding UK Application No. GB1415585.7.

* cited by examiner

*Primary Examiner* — Blake A Tankersley
*Assistant Examiner* — John M Royston
(74) *Attorney, Agent, or Firm* — Fitzpatrick, Cella, Harper & Scinto

(57) ABSTRACT

The sheet binding apparatus comprises a movable stapler for binding a sheet bundle formed of a plurality of sheets; a movable stapler movement motor for moving the movable stapler between a first position and a second position, the first position, at which sheet conveyance from the image forming apparatus connected so as to be capable of feeding a sheet, and the second position, at which the sheet conveyance is not hampered and a sheet bundle which is manually provided without using the image forming apparatus is bound; and CPU for controlling the movable stapler movement motor to cause, when the image forming apparatus is in a state of not forming the image, the movable stapler to stand by at the second position.

9 Claims, 4 Drawing Sheets

SHEET BINDING PROCESSING APPARATUS, IMAGE FORMING SYSTEM AND BINDING METHOD

BACKGROUND OF THE INVENTION

1. Field of the Invention

The present invention generally relates to an image forming system comprising an image forming apparatus, and a post-processing apparatus for performing post-processing on a sheet after image formation. More particularly, the present invention relates to a technology for binding a sheet bundle formed of a plurality of sheets such as paper having an image formed thereon.

2. Description of the Related Art

Image forming systems may include a post-processing apparatus for performing various kinds of post-processing on a sheet having an image formed thereon by an image forming apparatus. As this type of post-processing apparatus, for example, there is known a sheet binding processing apparatus including a stapler for binding a sheet bundle formed of a plurality of sheets through a use of a binding member such as a metal staple.

In a sheet binding processing apparatus, generally, the sheet bundle delivered from the image forming apparatus is automatically bound by the stapler ("automatic stapling"). On the other hand, there is a demand to bind the sheet bundle through a manual operation by a user ("manual stapling") instead of the automatic stapling.

To meet the users' demand as described above, U.S. Pat. No. 7,407,156B2 discloses such a technology that the user manually inserts the sheet bundle through a delivery port of the post-processing apparatus, to thereby bind the sheet bundle with the stapler.

In the technology disclosed in U.S. Pat. No. 7,407,156B2, when the manual stapling is performed, the user needs to insert the sheet bundle through the delivery port provided in a side of the post-processing apparatus. Therefore, it is desired to improve an operability of the sheet binding processing apparatus. From the viewpoint of improving the operability, it is conceived that the insertion port for the sheet bundle is arranged in a front surface of the post-processing apparatus, which is highly accessible to the user. In such a configuration, when one position of a corner of the sheet bundle is bound, it is not necessary to insert the sheet bundle in the deep part of the post-processing apparatus. Instead, by simply inserting a part of the sheet bundle in the insertion port provided in a front surface of the post-processing apparatus, the manual stapling can be performed.

In the configuration as described above, however, the position at which the stapler stands by (standby position) for binding the sheets becomes a problem. Generally, one stapler is provided in the post-processing apparatus. Through the movement of the stapler by a shifting mechanism, the sheet bundle can be bound at various positions by the post-processing apparatus. Taking into consideration of the fact that a print job including an instruction to bind the sheet is performed, the standby position of the stapler is set to a position different from the position for manual stapling. Therefore, when manual stapling is performed, the user needs to wait during a period in which the stapler is moved to a predetermined position.

SUMMARY OF THE INVENTION

The sheet binding apparatus of the present disclosure is connected to an image forming apparatus for forming an image on a sheet. The sheet binding apparatus comprises a binding section configured to bind a sheet bundle formed of a plurality of sheets; a shifting section configured to move the binding section between a first position and a second position, the first position, at which sheet conveyance from the image forming apparatus to the binding section is not hampered, and the second position, at which the sheet conveyance from the image forming apparatus to the binding section is not hampered and a sheet bundle which is manually provided is bound; and a control section configured to control the shifting section to cause the binding section to stand by at the second position in a state where the image is not formed by the image forming apparatus.

Further features of the present invention will become apparent from the following description of exemplary embodiments (with reference to the attached drawings).

DESCRIPTION OF THE EMBODIMENTS

Now, an embodiment of the present invention is described.

Figure 1:
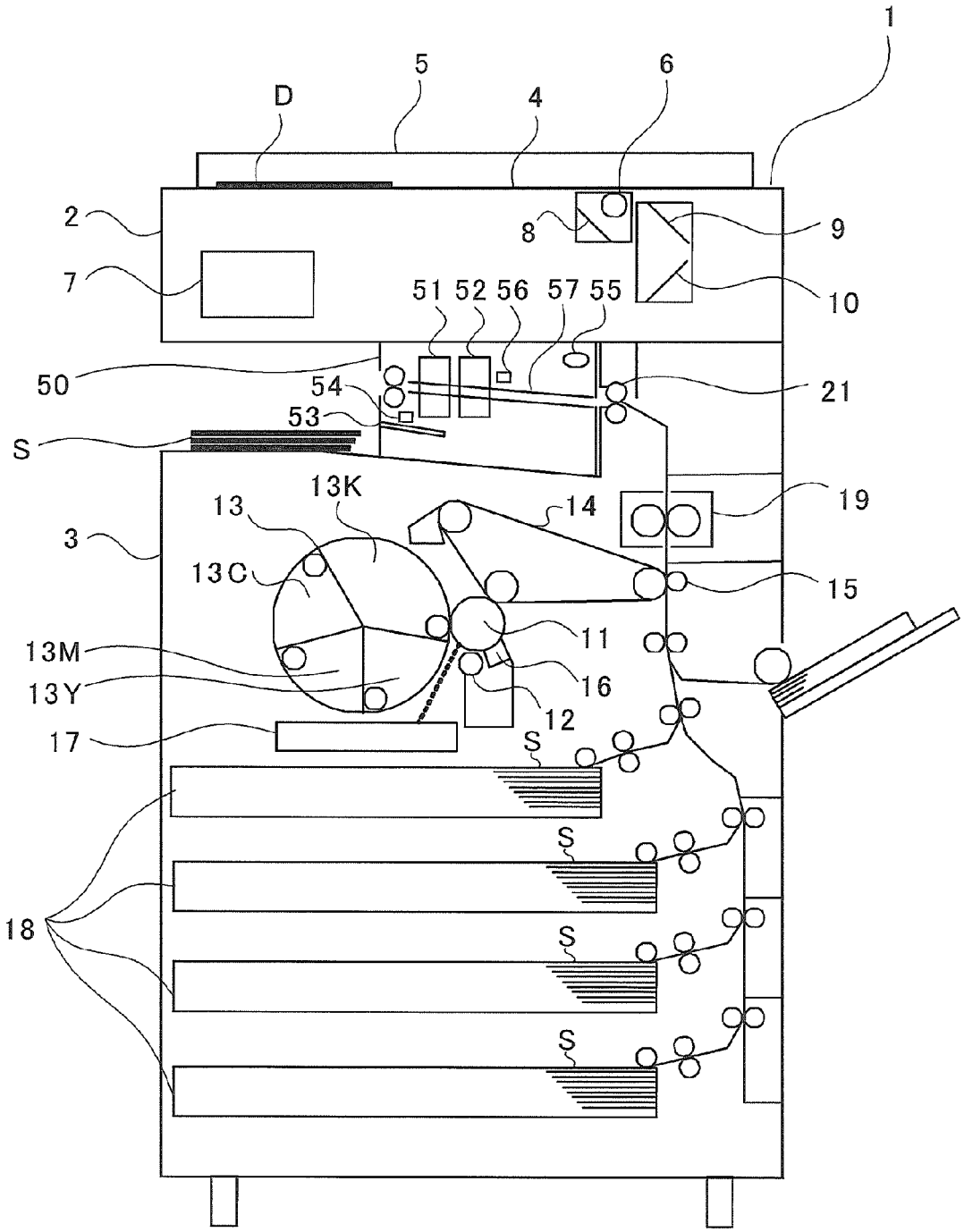
FIG. 1 is an overall configuration diagram illustrating an image forming system.

FIG. 1 is an overall configuration diagram illustrating an image forming system according to this embodiment. The image forming system includes an image forming apparatus 1 and a sheet binding apparatus 50. The sheet binding apparatus 50 is taken as an example of a post-processing apparatus for performing post-processing on a sheet received from the image forming apparatus 1 after image formation. In relation to the sheet binding apparatus 50, the image forming apparatus is taken as an example of an external apparatus connected to the sheet binding apparatus 50 so as to be capable of feeding a sheet.

<Image Forming Apparatus>

The image forming apparatus 1 includes an image reading section 2 for reading an image of a document, and an image forming section 3 for forming the image on a sheet S. Further, a toner that is an example of a developer is used as a color material for image formation.

A document table 4 formed of a transparent glass plate is provided at an upper portion of the image reading section 2. A user places a document D at a predetermined position on the document table 4 with its image surface oriented downward, and then presses and fixes the document D with a document pressing plate 5. An optical system is provided on a lower side of the document table 4. The optical system includes a lamp 6 for illuminating the document D, and reflection mirrors 8, 9, and 10 for guiding an optical image of the illuminated document D to an image processing unit 7. The lamp 6 and the reflection mirrors 8, 9, and 10 move at a predetermined speed to scan the document D.

The image forming section 3 includes a photosensitive drum 11, a primary charging roller 12, a rotary developing unit 13, an intermediate transfer belt 14, a transfer roller 15, a cleaner 16, a laser unit 17, sheet cassettes 18, a fixing device 19, and a delivery roller pair 21.

The primary charging roller 12 uniformly charges a surface of the photosensitive drum 11 before laser light irradiation. Based on image data, the laser unit 17 irradiates the charged surface of the photosensitive drum 11 with the laser beam to form electrostatic latent images. The rotary developing unit 13 adheres magenta, cyan, yellow, and black toners to the electrostatic latent images formed on the surface of the photosensitive drum 11 to form toner images.

The rotary developing unit 13 includes a developing device 13K, a developing device 13Y, a developing device 13M, and a developing device 13C, and is rotatable by a motor (not shown). The developing device 13K, the developing device 13Y, the developing device 13M, and the developing device 13C are used for developing a black toner image, a yellow toner image, a magenta toner image, and a cyan toner image, respectively.

When forming a monochrome toner image on the photosensitive drum 11, the developing device 13K is moved through rotation to a developing position that is proximate to the photosensitive drum 11, to thereby develop the toner image. Similarly, when forming a full-color toner image, each of the developing devices 13Y, 13M, 13K is arranged at the developing position through the rotation of the rotary developing unit 13, to thereby develop the toner image of the corresponding color.

The toner images developed on the surface of the photosensitive drum 11 are transferred onto the intermediate transfer belt 14. The toner images on the intermediate transfer belt 14 are transferred by the transfer roller 15 onto the sheet S that is fed from one of the sheet cassettes 18. The cleaner 16 removes the toners remaining on the photosensitive drum 11 after the toner images are transferred. The fixing device 19 heats and pressurizes the conveyed sheet S to fix the toner images on the sheet S. The sheet S having the toner images fixed thereto by the fixing device 19 is delivered from the image forming apparatus 1 by the delivery roller pair 21. The sheet S is delivered from the image forming apparatus 1 to the sheet binding apparatus 50 that is installed on a downstream side of the image forming apparatus 1.

<Sheet Binding Apparatus>

Next, the sheet binding apparatus 50 is described. The sheet binding apparatus 50 is provided at a position at which the sheet S is delivered from the image forming apparatus 1. The sheet binding apparatus 50 includes a binding mechanism for receiving the sheet S delivered from the image forming apparatus 1, and binding a sheet bundle formed of a plurality of the sheets S (example of a sheet bundle formed of a plurality of sheets), a shifting mechanism for moving the binding mechanism, and a control mechanism for controlling the shifting mechanism. The sheet binding apparatus 50 and the image forming apparatus 1 communicate to and from each other via a signal line (not shown), to thereby mutually monitor the states thereof and operate in cooperation.

The sheet binding apparatus 50 includes a movable stapler 51, an eco-stapler 52, a manual stapling sheet insertion port 53, a manual stapling sheet detection sensor 54, a manual stapling execution button 55, a sheet detection sensor 56, and a sheet alignment section 57. The movable stapler 51 is a stapler that shifts (moves) its position by the above-mentioned shifting mechanism.

When the sheet detection sensor 56 for detecting the presence and absence of the sheets S detects the sheets S delivered to the sheet alignment section 57, the movable stapler 51 and the eco-stapler 52 bind the sheets S in accordance with a binding mode set by the user.

The movable stapler 51 binds the sheets S through use of a staple. Therefore, the movable stapler 51 is also called a stapler with staple. The eco-stapler 52 includes an upper tooth portion and a lower tooth portion that are engageable with each other. The eco-stapler 52 sandwiches and pressurizes the sheet bundle between the upper tooth portion and the lower tooth portion, to thereby bind the sheet bundle without use of a staple. Therefore, the eco-stapler 52 is also called a stapler without staple.

The manual stapling sheet insertion port 53 is provided so that the user manually inserts the sheet bundle therethrough. The manual stapling sheet detection sensor 54 detects that the sheet bundle is inserted through the manual stapling sheet insertion port 53. When the manual stapling sheet detection sensor 54 detects the sheet bundle, the manual stapling execution button 55 is brought into a depressible (pushable) state. When the user depresses the manual stapling execution button 55, the sheet bundle is bound by the movable stapler 51. It means that when the sheet bundle, fed from an apparatus other than the external apparatus such as the image forming apparatus, is inserted through the manual stapling sheet insertion port 53, the manual stapling is performed.

Now, the movable stapler 51 is described in detail.

Figure 2:
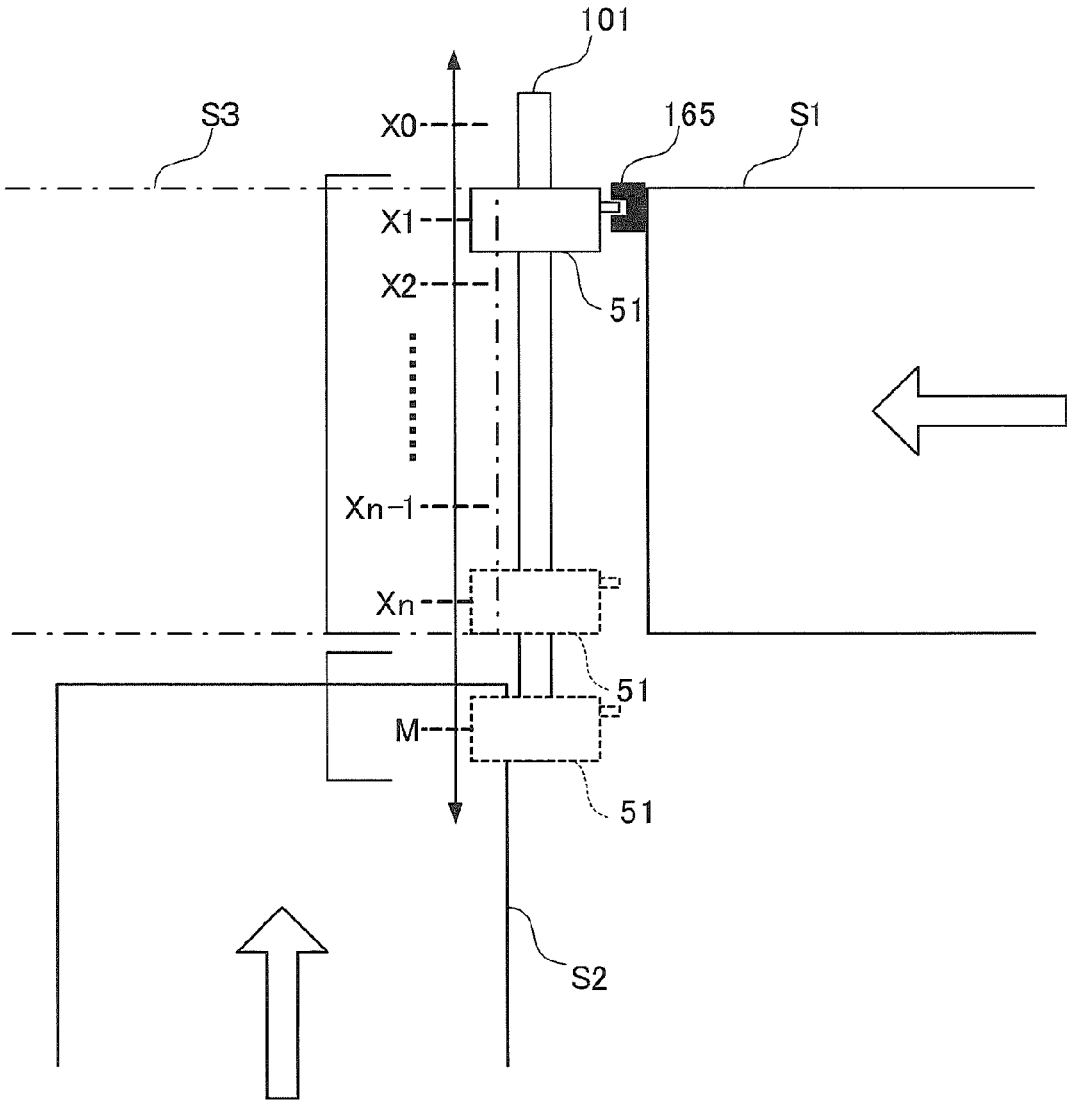
FIG. 2 is an explanatory view illustrating a movable stapler.

FIG. 2 is a sectional view illustrating the sheet binding apparatus 50 as seen from the top. The lower side of FIG. 2 corresponds to a front surface side of the sheet binding apparatus 50 illustrated in FIG. 1. The movable stapler 51 takes two roles. One is a role of an automatic stapling function for automatically binding sheets S1 delivered from the image forming apparatus 1 in accordance with a binding position previously set. The other is a role of a manual stapling function for manually binding sheets S2 inserted through the manual stapling sheet insertion port 53.

When the movable stapler 51 is used for the automatic stapling function, the movable stapler 51 binds the sheets S1 in accordance with a binding position set by the user. Therefore, the movable stapler 51 moves along a movement path 101 under the control of the shifting mechanism, and binds the sheets S1 at an arbitrary position (hereinafter referred to as "automatic stapling position") selected from among positions X1 to Xn. The position of the sheets to be subjected to the automatic stapling is a position of sheets S3 indicated by the chain line in FIG. 2. When left upper position of a printing surface of the sheets S3 is to be bound, the movable stapler 51 binds the sheets S3 at the position of X1. When right upper position of the printing surface of the sheets S3 is to be bound, the movable stapler 51 binds the sheets S3 at the position of Xn. Note that, the number of the sheets S3 that can be bound at the automatic stapling position differs depending on product specifications of the sheet binding apparatus 50.

A conveyance path for conveying the sheets S1 to the position of the sheets S3 intersects with the movement path 101 of the movable stapler 51. Therefore, if the movable stapler 51 stands by at the positions of X1 to Xn on the movement path 101 when conveying the sheets S1 to the position of the sheet S3, the movable stapler 51 hampers the conveyance of the sheets S1. The movable stapler 51 is made to retreat at a position at which the sheet conveyance is not hampered. The position is, for example, a standby position X0 located at a rear side of the movement path (a first position) or a position M (a second position) so as not to hamper the conveyance of the sheets S1.

On the other hand, when manual stapling is performed, the movable stapler 51 binds the sheet bundle S2 inserted through the manual stapling sheet insertion port 53. The manual stapling sheet insertion port 53 is provided in a front surface side of the sheet binding apparatus 50. Therefore, when the sheets are bound through the manual stapling, the movable stapler 51 moves to the position M (hereinafter referred to as "manual stapling position").

As described above, the position of the movable stapler 51 differs between the case where the automatic stapling is performed and the case where the manual stapling is performed.

Therefore, it is necessary to move the movable stapler 51 to an appropriate position in accordance with the respective cases. At this time, it is also necessary to consider a time required for the movement of the movable stapler 51. This is because a waiting time required for binding the sheets through the automatic stapling or the manual stapling changes depending on the standby position of the movable stapler 51.

<Function of Entire Image Forming System>

Figure 3:
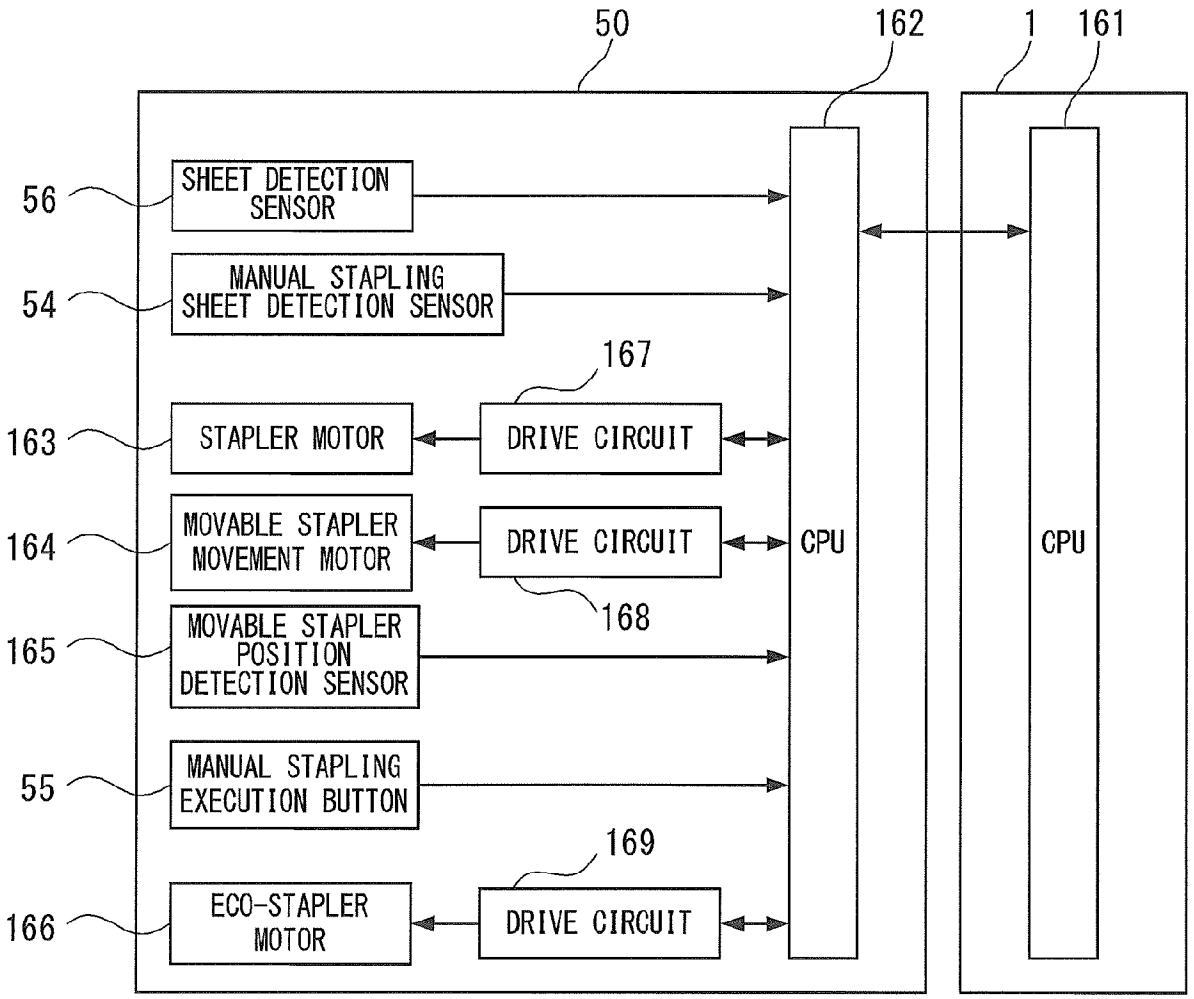
FIG. 3 is a configuration diagram illustrating a control device of the image forming system.

FIG. 3 is a configuration diagram illustrating a control device of the image forming system.

The sheet binding apparatus 50 is mainly controlled by a CPU 162. The CPU 162 communicates to and from a control device for controlling the image forming apparatus 1, for example, a CPU 161, to thereby mutually detect (or determine) the operation states thereof.

The sheet detection sensor 56 detects the presence and absence of the sheets in the sheet alignment section 57 (see FIG. 1), and notifies the CPU 162 of the detection result. The manual stapling sheet detection sensor 54 detects the presence and absence of the sheets in the manual stapling sheet insertion port 53 (see FIG. 1), and notifies the CPU 162 of the detection result. A stapler motor 163 is provided inside the movable stapler 51 (see FIG. 1), and drives the movable stapler 51 to bind the sheets. A drive circuit 167 controls the stapler motor 163. A movable stapler movement motor 164 is formed of a stepper motor. Further, the movable stapler movement motor 164 moves the movable stapler 51 to an arbitrary position by changing the number of drive pulses to be output in accordance with the distance detected by the movable stapler position detection sensor 165. A drive circuit 168 is configured to drive the movable stapler movement motor 164. The manual stapling execution button 55 notifies the CPU 162 of its depression. An eco-stapler motor 166 is provided inside the eco-stapler 52 (see FIG. 1), and is driven by a drive circuit 169 so that the eco-stapler 52 binds the sheets.

In a case where the movable stapler 51 stands by at the rear side of the sheet binding apparatus 50 (position X illustrated in FIG. 2), the movable stapler 51 can move to a left upper position of the sheets S3, at which the sheets S3 are bound through the automatic stapling with high frequency, in the minimum time. The standby position, however, is far from the position for manual stapling (position M illustrated in FIG. 2). Therefore, even when the user inserts the sheets S2 through the manual stapling sheet insertion port 53, the user cannot execute the manual stapling immediately. To perform the manual stapling, the user needs to wait for a time period (for example, about 5 seconds) required for the movable stapler 51 to move from the position X0 to the position M illustrated in FIG. 2.

On the contrary, in a case where the movable stapler 51 stands by at the manual stapling position (position M illustrated in FIG. 2), when the user inserts the sheets S2 through the manual stapling sheet insertion port 53, the user can execute the manual stapling immediately. In this case, however, it takes time for the movable stapler 51 to move to the left upper position of the sheets S3, at which the sheets S3 are bound through the automatic stapling with high frequency (position X1 illustrated in FIG. 2). This increases time to start the sheet binding.

As described above, the standby positions of the movable stapler 51 are in a trade-off relationship between the case where greater priority is placed on the productivity of automatic stapling and the case where greater priority is placed on the productivity of manual stapling.

Incidentally, in a case, for example, where sheet conveyance speed of the image forming apparatus 1 is slow, it requires, for example, more than or equal to 5 seconds from when the image formation on a sheet is started till when the sheet S1 after the image formation arrives at the sheet binding apparatus 50. Therefore, even when the movable stapler 51 stands by at the manual stapling position (position M), there is enough time for the movable stapler 51 to move to the rear side position (position X0) of the sheet binding apparatus 50. It means that, if the movable stapler 51 starts to move immediately after the print job is input, the movable stapler 51 is able to move to the rear side position (position X0) of the sheet binding apparatus 50 before the image forming apparatus 1 forms the image on the sheet and the sheet after the image formation is delivered to the sheet binding apparatus 50.

Even in a case where the sheet conveyance speed of the image forming apparatus 1 is so fast that it requires less than 5 seconds from when the image formation on the sheet is started till when the sheet S1 after the image formation arrives at the sheet binding apparatus 50, it is possible to reduce the waiting time caused by the movement of the movable stapler 51. It means that the waiting time caused by the movement of the movable stapler 51 can be reduced to a difference between the time taken by the movable stapler 51 to move and the time taken for the sheets to arrive from the image forming apparatus 1 to the sheet binding apparatus 50.

As described above, it is possible to effectively reduce the waiting time caused by the movement of the movable stapler 51 in both modes, i.e., when the manual stapling is executed and when the automatic stapling is executed.

Figure 4:
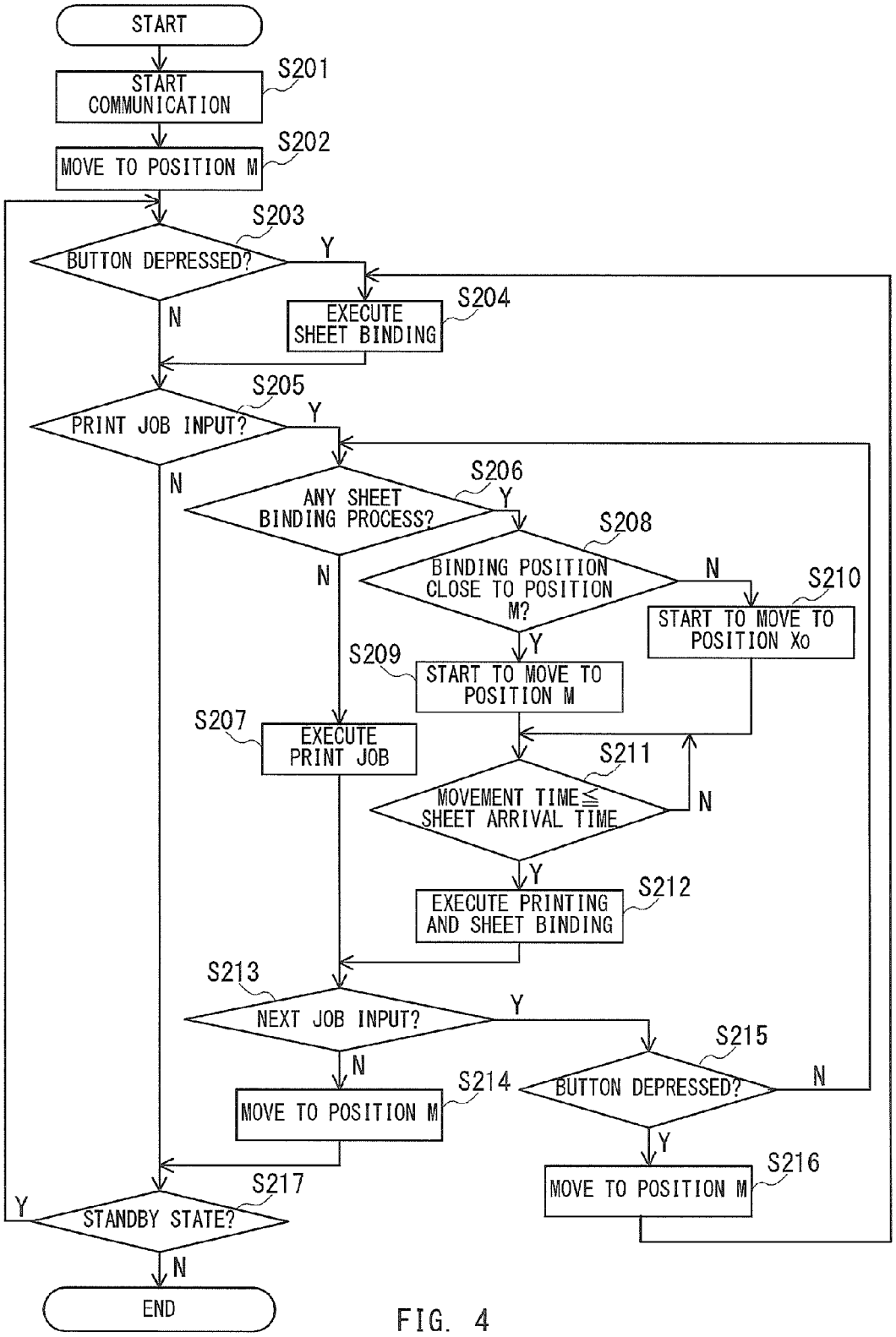
FIG. 4 is a flowchart illustrating sheet binding.

Description will be made in detail with regard to a sheet binding operation with the flowchart illustrated in FIG. 4 in a case where the standby position of the movable stapler 51 is set to the manual stapling position (position M) of the sheet binding apparatus 50.

<Operation to be Performed when Movable Stapler is Moved>

The control of the position of the movable stapler 51 is performed in cooperation between the control device of the sheet binding apparatus 50 (CPU 162) and the control device of the image forming apparatus (CPU 161). When the image forming system is powered on, the CPU 162 of the sheet binding apparatus 50 periodically communicates to and from the image forming apparatus 1 (CPU 161) so as to exchange operation information or the like (S201).

The CPU 162 drives the movable stapler movement motor 164 by a predetermined number of pulses, to thereby move the movable stapler 51 to the manual stapling position (position M illustrated in FIG. 2) (S202). The movable stapler 51 stands by at this position. At this point, the print job is not input to the image forming apparatus 1. When the manual stapling execution button 55 is depressed (S203: Y), the CPU 162 binds the sheets through the manual stapling without moving the movable stapler 51 (S204).

When the manual stapling execution button 55 is not depressed (S203: N), or it is after the execution of the manual stapling, the CPU 162 waits for the input of the print job from the CPU 161 of the image forming apparatus 1 (S205). The CPU 162 is in a standby state until the print job is input (S205: N, S207). When the standby state is continued (S217: Y), the CPU 162 stands by till the manual stapling execution button 55 is depressed and the print job is input. When the image forming system is powered off and the like, the standby state is ended (S217: N).

When the print job is input from the CPU 161 of the image forming apparatus 1 (S205: Y), the CPU 162 determines whether or not the sheet binding is included in the print job (S206). If it is determined that the sheet binding is not included in the print job (S206: N), the CPU 162 does not control the operation of the movable stapler 51. In this case, the print job is executed by the CPU 161 of the image forming apparatus 1 (S207). The movable stapler 51 remains in a standby state at the position M.

If it is determined that the sheet binding is included in the print job (S206: Y), the CPU 162 obtains a binding position at which the sheets are bound in the print job. The CPU 162 determines which one of the manual stapling position (position M illustrated in FIG. 2) and the standby position located at the rear side (position X0 illustrated in FIG. 2) is closer to the binding position as obtained (S208). If it is determined that the binding position as obtained is closer to the manual stapling position M (S208: Y), the CPU 162 starts to move to the manual stapling position M (S209). If it is determined that the binding position as obtained is closer to the standby position located at the rear side (S208: N), the CPU 162 starts to move to the standby position X0 located at the rear side (210).

The CPU 162 compares a first period with a second period. The first period represents a time left for the movement taken by the movable stapler 51 to arrive at the manual stapling position or the standby position located at the rear side. The second period represents a time taken from when the print job is started till when the sheet arrives at the sheet binding apparatus 50. The first period as described above reduces in accordance with the movement of the movable stapler 51. When the first period becomes less than or equal to the second period (S211: Y), the CPU 162 notifies the image forming apparatus (CPU 161) of that. If the movement time of the movable stapler 51 becomes less than or equal to the time taken from when the print job is started till when the sheet arrives at the sheet binding apparatus 50, the stapler 51 will not hamper the conveyance of the sheets S2.

In response to the notification from the CPU 162, the image forming apparatus (CPU 161) executes the print job. Through the execution of the print job, the sheets having the images formed thereon are delivered to the sheet binding apparatus 50. The sheet binding apparatus 50 (CPU 162) moves the movable stapler 51 to the binding position as obtained at step S208 from the standby position, to thereby bind the sheet bundle as delivered (S212).

After the execution of the print jobs at steps S207 and S212, the CPU 162 determines the presence and absence of the input of the next print job (S213). If it is determined that the next print job is not input (S213: N), the CPU 162 moves the movable stapler 51 to the manual stapling position (position M illustrated in FIG. 2) (S214). After the movement of the movable stapler 51, if the image forming system is in a standby state, the CPU 162 stands by in preparation for the next manual stapling operation or print job (S217: Y).

If it is determined that the next print job is input (S213: Y), the CPU 162 determines whether or not the manual stapling execution button 55 is depressed (S215). If it is determined that the manual stapling execution button 55 is depressed (S215: Y), the CPU 162 moves the movable stapler 51 to the manual stapling position (S216), to thereby execute the manual stapling operation (S204). If it is determined that the manual stapling execution button 55 is not depressed (S215: N), the CPU 162 moves to the next processing while keep staying the movable stapler 51 at the current position (S206).

As described above, the CPU 162 reduces the user's waiting time when the manual stapling is executed by causing the movable stapler 51 to stand by at the manual stapling position (position M) when it is in a standby state. In a case where the print job including the sheet binding is input, the CPU 162 moves the movable stapler 51 to the standby position where is closer to the binding position (position X0 or M) before the print job is started, to thereby reduce time required for the sheet binding.

The above description is given on the premise that the sheet binding apparatus 50 is installed in the image forming apparatus 1. However, the present invention is not limited to this installation manner. The sheet binding apparatus 50 may also be provided as an independent apparatus to be used in conjunction with the image forming apparatus 1. Further, the sheet binding apparatus 50 is described as an example of the post-processing apparatus, but the movable stapler 51 may be mounted on the image forming apparatus 1 itself. Still further, the stapler using a staple is described as an example of the movable stapler 51, but the movable stapler 51 may also be applied to other sheet binding mechanisms.

The present invention has been described in detail by way of the above-mentioned embodiments, but the scope of the present invention is not limited to those embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of priority from Japanese Patent Application No. 2013-187089, filed Sep. 10, 2013 and Japanese Patent Application No. 2014-150578, filed Jul. 24, 2014, which are hereby incorporated by reference herein in their entirety.

What is claimed is:

1. A sheet binding apparatus connected to an image forming apparatus for forming an image on a sheet comprising:

a binding section configured to bind a sheet bundle formed of a plurality of sheets;

a shifting section configured to move the binding section between a first position and a second position, the first position being a position at which sheet conveyance from the image forming apparatus to the binding section is not hampered, and the second position being a position at which the sheet conveyance from the image forming apparatus to the binding section is not hampered and a sheet bundle which is manually provided is bindable; and a control section configured to control the shifting section to cause, when the image forming apparatus is in a standby state in which the image forming apparatus is not executing image formation but is waiting for input of a print job, the binding section to stand by at the second position, wherein, in a case where the binding section is at the second position and an instruction to start a print job in which no binding processing is designated is input to the image forming apparatus, the control section causes the binding section to remain in the second position.

2. The sheet binding apparatus according to claim 1, wherein the binding section is configured to perform binding processing on the sheet bundle at a designated binding position, and wherein, in a case where a print job in which the binding processing is designated is input, the control section is configured to control the shifting section so as to move the binding section to the one of the first position and the second position which is closer to a binding position designated in the printing job before the sheet is fed from the image forming apparatus.

3. The sheet binding apparatus according to claim 1, wherein, in a case where a first period becomes less than or equal to a second period, the control section causes the image forming apparatus to execute the image formation, the first period representing a time left for the binding section to arrive at one of the first position or the second position, and the second period representing a time taken for the image forming apparatus to feed the sheet to the sheet binding apparatus.

4. An image forming system comprising:

an image forming section configured to form an image on a sheet;

a binding section configured to bind a sheet bundle formed of a plurality of sheets;

a shifting section configured to move the binding section between a first position and a second position, the first position being a position at which sheet conveyance from the image forming section to the binding section is not hampered, and the second position being a position at which the sheet conveyance from the image forming section to the binding section is not hampered and a sheet bundle which is manually provided is bindable; and a control section configured to control the shifting section to cause, when the image forming section is in a standby state in which the image forming apparatus is not executing image formation but is waiting for input of a print job, the binding section to stand by at the second position, wherein, in a case where the binding section is at the second position and an instruction to start a print job in which no binding processing is designated is input to the image forming apparatus, the control section causes the binding section to remain in the second position.

5. The image forming system according to claim 4, wherein the binding section is configured to perform binding processing on the sheet bundle at a designated binding position, and wherein, in a case where a print job in which the binding processing is designated is input, the control section is configured to control the shifting section so as to move the binding section to one of the first position and the second position which is closer to a binding position designated in the printing job before the sheet is fed from the image forming section.

6. The image forming system according to claim 4, wherein, in a case where a first period becomes less than or equal to a second period, the control section causes the image forming section to execute image formation, the first period representing a time left for the binding section to arrive at one of the first position or the second position, and the second period representing a time taken for the image forming section to feed the sheet to the sheet binding apparatus.

7. A sheet binding method which is executed by a binding apparatus, connected to an image forming apparatus for forming an image on a sheet which comprises:

a binding section configured to bind a sheet bundle formed of a plurality of sheets; and a shifting section configured to move the binding section between a first position and a second position, the first position being a position at which sheet conveyance from the image forming apparatus to the binding section is not hampered, and the second position being a position at which the sheet conveyance from the image forming apparatus to the binding section is not hampered and a sheet bundle which is manually provided without using the image forming apparatus is bound, the method comprising:

standing by the binding section at the second position in a state in which the image forming apparatus is not executing image formation but is waiting for input of a print job; and when the sheet bundle is fed from the image forming apparatus, moving the binding section to a binding position by the shifting section to bind the sheet bundle, wherein, in a case where the binding section is at the second position and an instruction to start a print job in which no binding processing is designated is input to the image forming apparatus, the binding section remains in the second position.

8. The sheet binding method according to claim 7, further comprising:

obtaining, in a case where the print job in which the binding processing is designated is input, a binding position designated in the print job; and moving, by the shifting section, the binding section to one of the first position and the second position which is closer to the binding position designated in the print job before the sheet is fed from the image forming section.

9. The sheet binding method according to claim 8, further comprising:

causing the image forming apparatus to execute the image formation in a case where a first period becomes less than or equal to a second period, the first period representing a time left for the binding section to arrive at one of the first position or the second position, and the second period representing a time taken for the image forming apparatus to feed the sheet to the sheet binding apparatus.

* * * * *